US011703803B2

(12) United States Patent
Villar et al.

(10) Patent No.: US 11,703,803 B2
(45) Date of Patent: Jul. 18, 2023

(54) MECHANICAL BRAKING DEVICE FOR A HOROLOGICAL MOBILE COMPONENT

(71) Applicant: ETA SA MANUFACTURE HORLOGÈRE SUISSE, Grenchen (CH)

(72) Inventors: Ivan Villar, Brügg (CH); Anne Philipps, Selzach (CH)

(73) Assignee: ETA SA MANUFACTURE HORLOGÈRE SUISSE, Grenchen (CH)

( * ) Notice: Subject to any disclaimer, the term of this patent is extended or adjusted under 35 U.S.C. 154(b) by 690 days.

(21) Appl. No.: 16/815,767

(22) Filed: Mar. 11, 2020

(65) Prior Publication Data

US 2020/0319595 A1 Oct. 8, 2020

(30) Foreign Application Priority Data

Apr. 3, 2019 (EP) ..... 19166951

(51) Int. Cl.
*G04B 13/02* (2006.01)
*G04B 35/00* (2006.01)

(52) U.S. Cl.
CPC ..... *G04B 13/021* (2013.01); *G04B 35/00* (2013.01)

(58) Field of Classification Search
CPC .... G04B 13/021; G04B 35/00; G04B 17/045; G04B 43/002; F16D 7/021
See application file for complete search history.

(56) References Cited

U.S. PATENT DOCUMENTS

2006/0187768 A1* 8/2006 Murazumi ..... G04B 13/023 368/324
2008/0113154 A1* 5/2008 Bitterli ..... G04D 3/0046 428/131

(Continued)

FOREIGN PATENT DOCUMENTS

CH 703470 A2 1/2012
CN 104487905 A 4/2015

(Continued)

OTHER PUBLICATIONS

Communication dated Oct. 16, 2019, issued by European Patent Office in counterpart European Application No. 19166951.4.

(Continued)

*Primary Examiner* — Edwin A. Leon
*Assistant Examiner* — Kevin Andrew Johnston
(74) *Attorney, Agent, or Firm* — Sughrue Mion, PLLC

(57) ABSTRACT

A braking device (100), separate and remote from its guide members, having resilient strips (3; 31; 32) borne by a braking mobile component (10) trapped between a structure (1) and a bolt (6) and movable perpendicularly to the axis of a horological mobile component arbor (30), on which the strips bear, and either all of the bearing forces on the arbor (30) of the strips (3) are exerted within a single angular sector having a centre angle (a) of less than 180°, or, opposite a first straight or convex strip (31) tangentially braking this arbor (30), a second strip (32) allows for relative mobility between the braking mobile component (10) and this arbor (30) in a direction of mobility (DM), the latter being: either parallel to the first resilient strip (31), or wavy and deformable perpendicularly to the direction of mobility (DM).

18 Claims, 6 Drawing Sheets

(56) References Cited

U.S. PATENT DOCUMENTS

| | | | | |
|---|---|---|---|---|
| 2016/0026154 | A1* | 1/2016 | Courvoisier | G04B 13/022 368/184 |
| 2016/0077491 | A1* | 3/2016 | Tanabe | G04B 13/02 368/322 |
| 2018/0284698 | A1* | 10/2018 | Cettour-Baron | G04B 31/00 |
| 2018/0307183 | A1* | 10/2018 | Villar | G04B 13/023 |

FOREIGN PATENT DOCUMENTS

| | | | |
|---|---|---|---|
| CN | 104914704 | A | 9/2015 |
| CN | 105425570 | A | 3/2016 |
| CN | 107430382 | A | 12/2017 |
| CN | 108983580 | A | 12/2018 |
| EP | 2068210 | A2 | 6/2009 |
| EP | 2487547 | A1 | 8/2012 |
| EP | 2977829 | A1 | 1/2016 |
| EP | 3396470 | A1 | 10/2018 |

OTHER PUBLICATIONS

Communication dated Mar. 16, 2021, from the China National Intellectual Property Administration application No. 202010259133.6.

* cited by examiner

MECHANICAL BRAKING DEVICE FOR A HOROLOGICAL MOBILE COMPONENT

CROSS-REFERENCE TO RELATED APPLICATIONS

This application is based on and claims priority under 35 USC 119 from European Patent Application No. 19166951.4 filed Apr. 3, 2019, which is incorporated herein by reference in its entirety.

FIELD OF THE INVENTION

The invention relates to a horological mechanism comprising a structure bearing at least one first device and/or one second device for guiding the pivoting of an arbor of a mobile component about an axis of rotation, and comprising at least one braking device which is separate and remote, in the direction of said axis of rotation, from any pivoting guiding device comprised in said mechanism, said braking device comprising at least one braking mobile component comprising at least one resilient strip arranged so as to exert a mechanical braking force on said arbor.

The invention further relates to a horological movement comprising at least one such horological mechanism.

The invention further relates to a watch comprising at least one such movement and/or at least one such horological mechanism.

The invention relates to the field of horological mechanisms, in particular display mechanisms.

BACKGROUND OF THE INVENTION

In a loose gear train, angular play between the display mobile components produces an unattractive visual effect for the user, known as fluttering, as is usually seen on a hand of a small seconds display with a loose gear train.

Some systems already exist, such as magnetic brakes, flexible toothings or springs acting as brakes. These are often leaf springs (metal foils) or strips rubbing against the mobile component, which have the drawback of producing a large variation in friction force and thus a variable disruption to operation.

The patent document EP3396470 filed by ETA SA describes a horological mechanism comprising a structure in which an arbor of a mobile component is pivoted, and comprising a braking device for the mechanical braking at constant torque of this arbor, this braking device comprises a braking component which is removable with respect to the structure and comprises, for attachment thereof to the structure, a solid felloe, which carries a plurality of resilient elements, regularly distributed around a common axis about which these resilient elements each have a contact area, these contact areas together defining an opening, arranged to engage, in a press fit with resilient gripping, with the arbor, to make this common axis coincide with the axis of rotation of the arbor, and to apply to the arbor a substantially constant tangential braking force.

SUMMARY OF THE INVENTION

The invention proposes reducing angular play, simply and economically, in the display mobile component device in a loose gear train, and easing radial insertion or extraction of a braking mobile component.

For this purpose, the invention relates to a horological mechanism according to claim 1.

The invention further relates to a horological movement comprising at least one such horological mechanism.

The invention further relates to a watch comprising at least one such movement and/or at least one such horological mechanism.

BRIEF DESCRIPTION OF THE DRAWINGS

Other features and advantages of the invention will be better understood upon reading the following detailed description given with reference to the accompanying drawings, in which:

FIG. 11 shows the braking mobile component in the free state, beside the structure;

FIG. 12 shows the insertion of the arbor in a clearing of the braking mobile component;

FIG. 13 shows the bearing of the single resilient strip on the arbor, which is diametrically bearing against an apex of a V shape comprised in the braking mobile component facing the resilient strip;

FIG. 14 shows the working position reached after crossing this apex, the arbor bears, on one side, against the V shape delimited by two apexes, and is braked on the opposite side by the single resilient strip, the forks of the braking mobile component surround the bolt with a small play; this bolt can then be turned one quarter turn in order to limit the axial displacement of the braking mobile component;

DETAILED DESCRIPTION OF THE PREFERRED EMBODIMENTS

Figure 1:
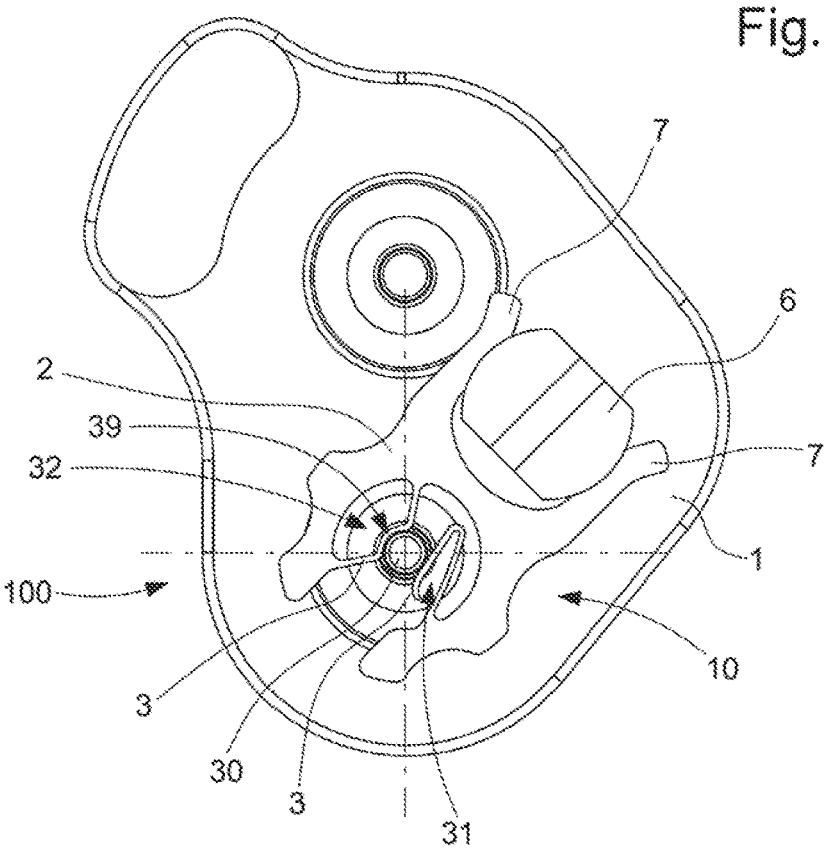
FIG. 1 shows a diagrammatic plan view of a part of a horological movement comprising a mechanism according to the invention, with a braking device which comprises a mobile component for braking an arbor of a mobile component, this braking mobile component being able to move relatively between a structure and a bolt, both in the direction of the axis of the mobile component to be braked and in a plane perpendicular thereto; the braking mobile component is shown in a first alternative embodiment comprising resilient arms jointly forming a hairspring, a first strip being substantially straight and tangent to the mobile component to be braked, and the other strip comprising two resilient notches on either side of the mobile component to be braked, easing the radial insertion or extraction of the braking mobile component relative to the mobile component to be braked.

The invention relates to a horological mechanism 1000 comprising a structure 1 bearing at least one first device 4 and/or one second device 5 for guiding the pivoting of an arbor 30 of a mobile component 400 about an axis of rotation D.

This mechanism 1000 comprises at least one braking device 100 which is separate and remote, in the direction of the axis of rotation D, from any pivoting guiding device 4, 5 or other, comprised in the mechanism 1000.

This braking device 100 comprises at least one braking mobile component 10, which comprises at least one resilient strip 3, 31, 32 arranged so as to exert a mechanical braking force on the arbor 30.

According to the invention, this at least one braking mobile component 10 extends substantially perpendicular to the axis of rotation D, and is mounted such that it is trapped between the structure 1 and a bolt 6 comprised in the mechanism 1000, and is capable of moving at least in a plane perpendicular to the axis of rotation D, relative to the structure 1 and to the arbor 30.

Figure 5:
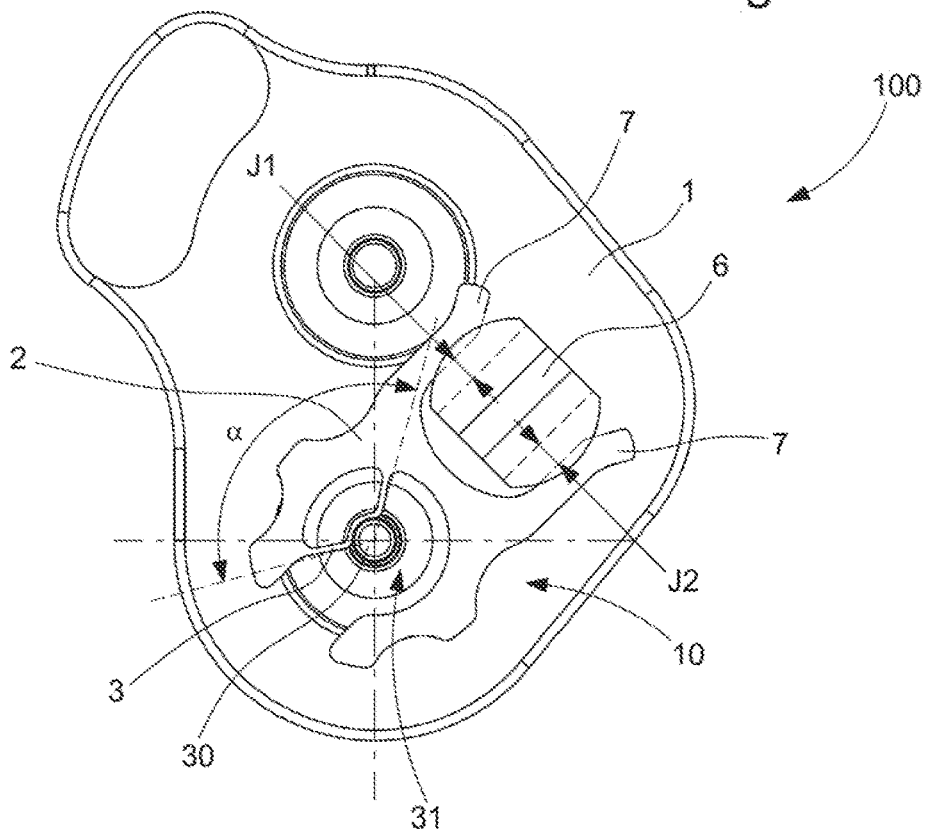
FIG. 5 shows, in a similar manner to FIG. 1, another alternative embodiment of the braking mobile component which comprises a single strip with a shoulder in the form of a hollow cylindrical sector, which extends about an angular sector of less than 180° relative to the axis of the mobile component to be braked.
Figure 6:
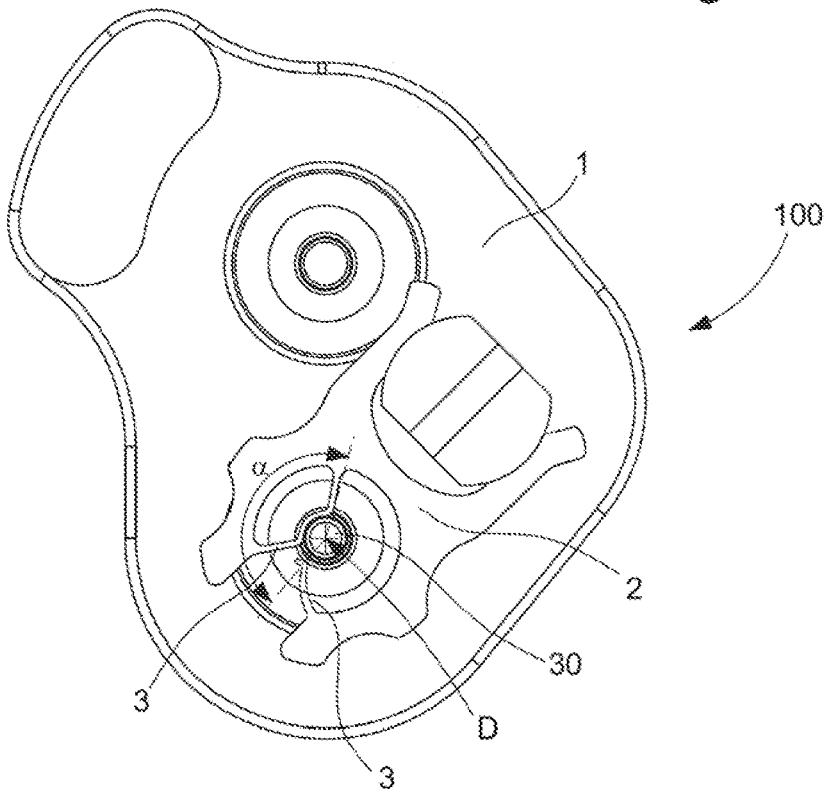
FIG. 6 shows, in a similar manner to FIG. 5, another alternative embodiment of the braking mobile component which comprises, in addition to the strip with a shoulder in the form of a hollow cylindrical sector in FIG. 5, another bearing strip, the set of strips extending about an angular sector of less than 180° relative to the axis of the mobile component to be braked.
Figure 7:
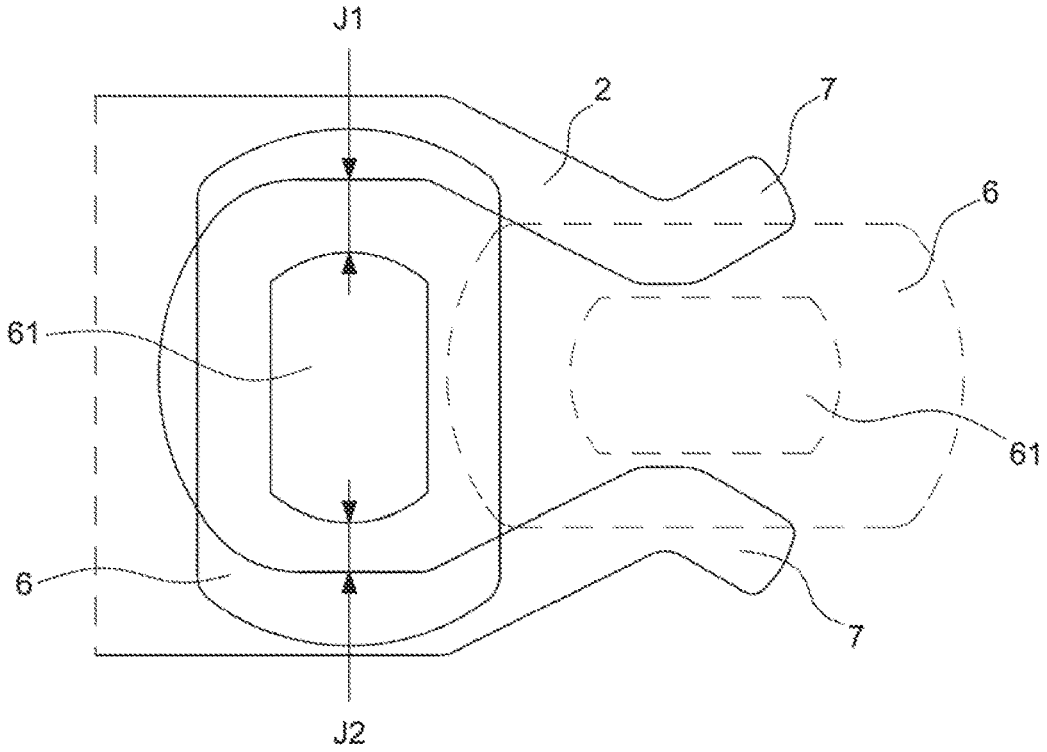
FIG. 7 shows a diagrammatic plan view of the two superimposed insertion and working positions, and shows the engagement of a narrow part of the limiting bolt through an opening in a fork comprised in the braking mobile component.

Furthermore, the arrangement of the strip 3, 31, 32, if only one is present as in FIG. 5, or the relative arrangement of the different strips 3, 31, 32, when the braking mobile component 10 comprises a plurality thereof, such as in the preferred alternative embodiments shown in the other figures, is such that:

either all of the bearing forces on the arbor 30 of all of the resilient strips 3, 31, 32 comprised in the braking mobile component 10 are exerted within a single angular sector having a centre angle $\alpha$ of less than 180° relative to the axis of rotation D, so as to allow for relative mobility between the braking mobile component 10 and the arbor 30 in a direction of mobility that lies within the angular sector;

or the braking mobile component 10 comprises a straight or convex first resilient strip 31 arranged so as to tangentially brake the arbor 30 and the direction whereof defines a direction of mobility DM that is perpendicular to the axis of rotation D, and, on the side opposite the first resilient strip 31 relative to the axis of rotation D, at least one second resilient strip 32 which is arranged so as to allow for relative mobility between the braking mobile component 10 and the arbor 30 in the direction of mobility DM, the second resilient strip 32 being:

either single, and straight or convex, and arranged so as to tangentially brake the arbor 30 substantially parallel to the first resilient strip 31, i.e. in a direction parallel to the tangency direction of the first resilient strip 31;

or wavy similar to that of a hairpin and comprising at least one resilient notch 39 that is deformable in a direction perpendicular to the axis of rotation D and to the direction of mobility DM.

More particularly, the structure 1 conventionally bears a first device 4 and a second device 5 for guiding the pivoting of the arbor 30 about the axis of rotation D, that are separate and remote from one another, and these two guiding devices are each separate and remote from the braking device 100.

More particularly, the structure 1 bears a first device 4 for guiding the pivoting of the arbor 30, which first guiding device 4 comprises either a first bearing 40 of the structure 1 engaging in a complementary manner with a first bearing block 41 of the arbor 30, or a first anchor 45 bearing a first flexible guide member 46 from which the arbor 30 is suspended or to which the arbor 30 is rigidly connected.

More particularly, the structure 1 bears a second device 5 for guiding the pivoting of the arbor 30, which second guiding device 5 comprises either a second bearing 50 of the structure 1 engaging in a complementary manner with a second bearing block 51 of the arbor 30, or a second anchor 55 bearing a second flexible guide member 56 from which the arbor 30 is suspended or to which the arbor 30 is rigidly connected.

More particularly, the braking mobile component 10 has axial mobility, with a first axial play, in the direction of the axis of rotation D, relative to the structure 1 and to the arbor 30.

More particularly, the braking mobile component 10 is arranged so as to apply mechanical braking at a constant torque to the arbor 30.

More particularly, the braking mobile component 10 comprises at least one shock-resistant banking 22, 23 which is arranged so as to limit the relative travel between the braking mobile component 10 and the arbor 30 in the direction of mobility DM. More particularly again, the braking mobile component 10 comprises at least two shock-resistant bankings 22, 23 which are disposed on either side of the arbor 30, as shown in FIGS. 2 and 3.

Figure 2:
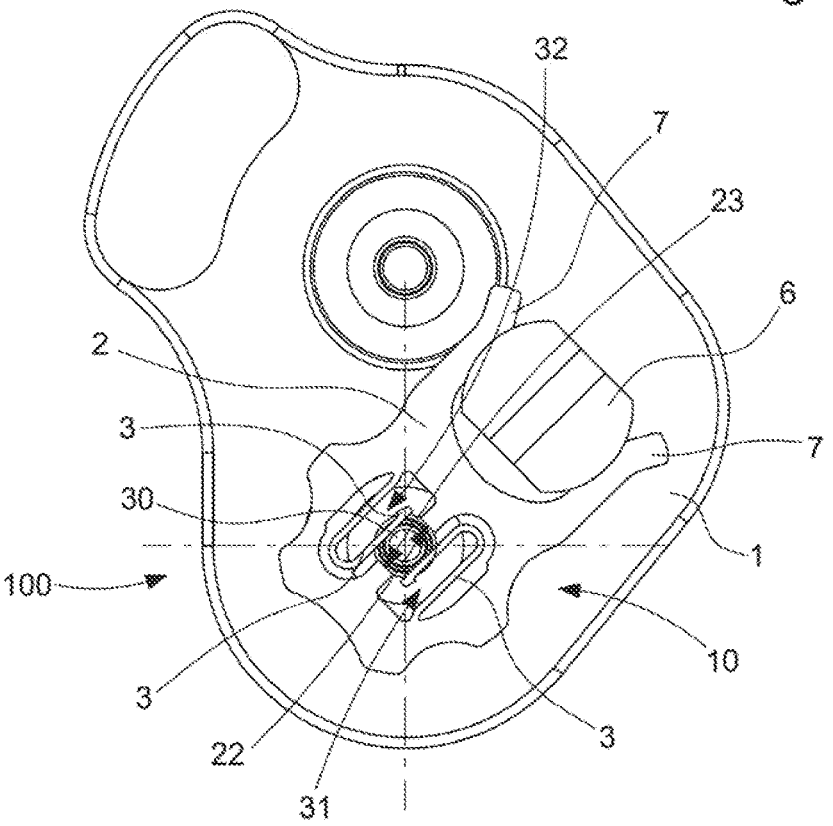
FIG. 2 shows, in a similar manner to FIG. 1, a second alternative embodiment of the braking mobile component, comprising two straight strips on either side of the mobile component to be braked, exerting tangential bearing forces substantially parallel to one another, the braking mobile component further comprising shock-resistant bankings for limiting the relative radial travel between the braking mobile component and the mobile component to be braked.
Figure 3:
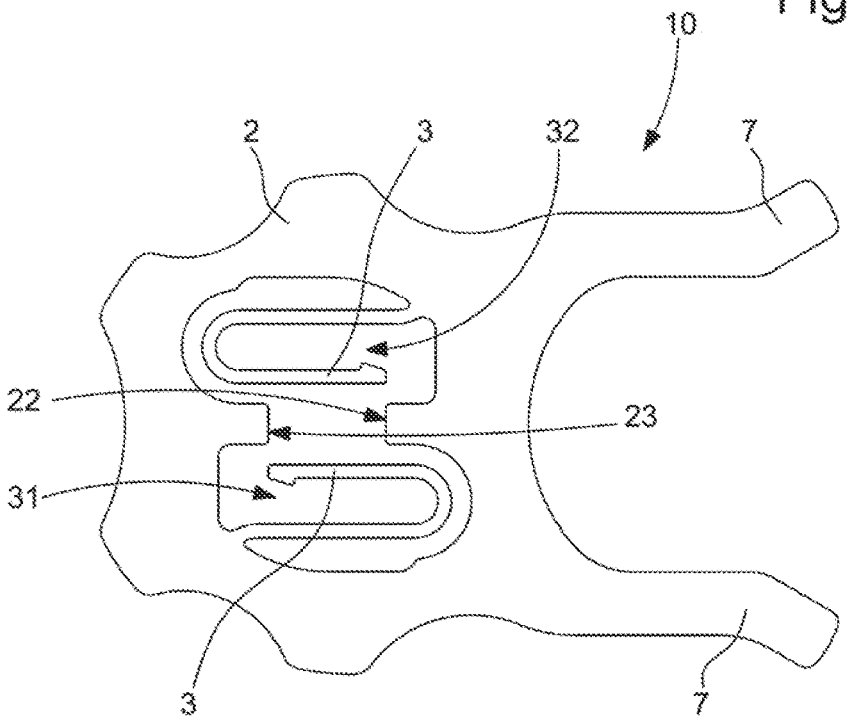
FIG. 3 shows the braking mobile component in FIG. 2 by itself.
Figure 8:
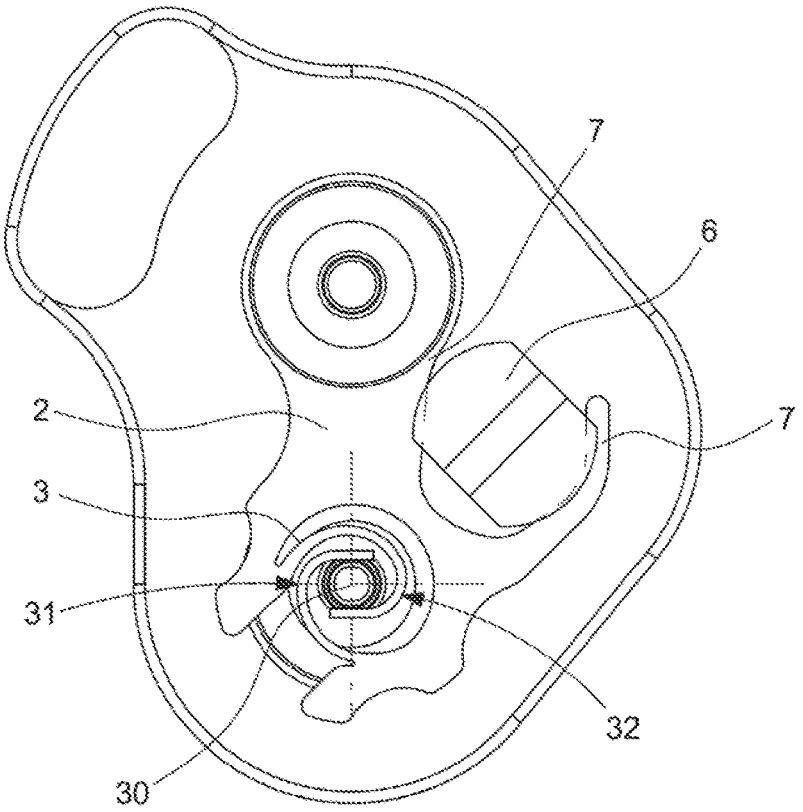
FIG. 8 shows, in a similar manner to FIG. 1, yet another alternative embodiment of the braking mobile component, pivoted by a pin on the bearing structure and the displacement whereof is still limited by such a bolt, and comprising two strips having a substantially spiral body and the ends whereof are straight on either side of the mobile component to be braked, exerting tangential bearing forces that are substantially parallel to one another.
Figure 9:
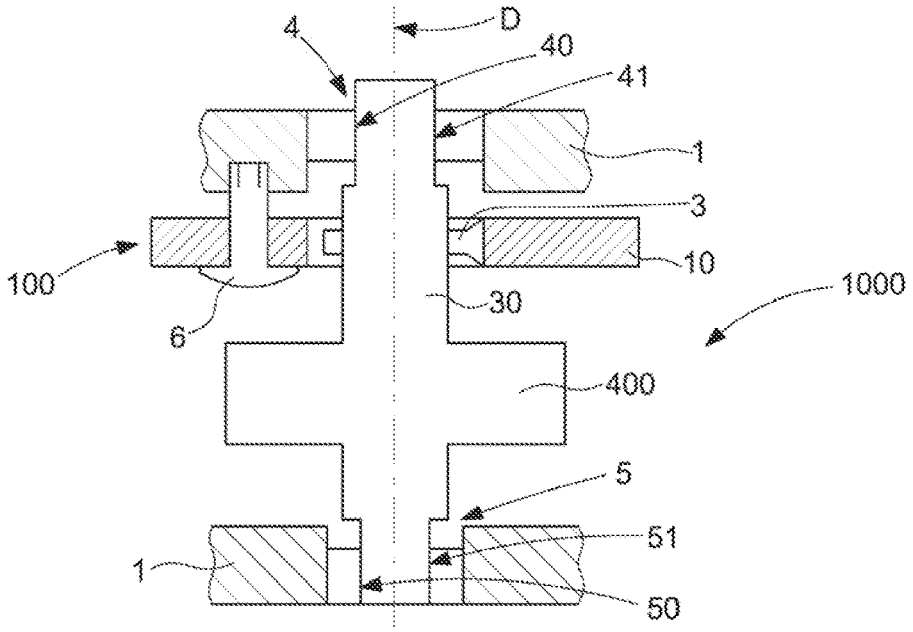
FIG. 9 diagrammatically shows a cross-section, passing through the axis of the mobile component to be braked, of the mechanism according to the invention in one embodiment with conventional pivots.
Figure 10:
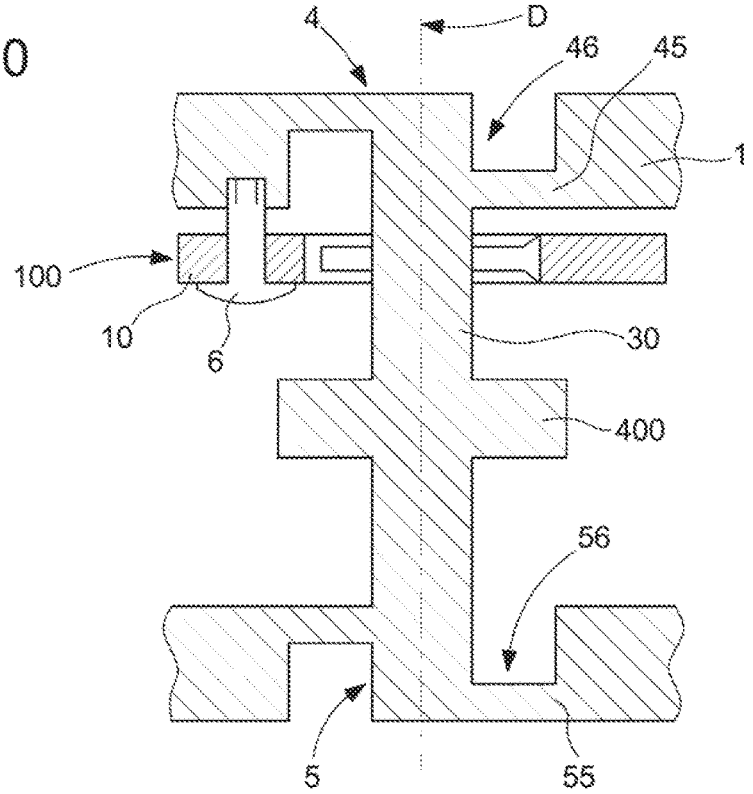
FIG. 10 diagrammatically shows a cross-section, passing through the axis of the mobile component to be braked, of the mechanism according to the invention in one embodiment with flexible pivots, and where the bearing structure can be in one piece with the mobile component to be braked.
Figure 15:
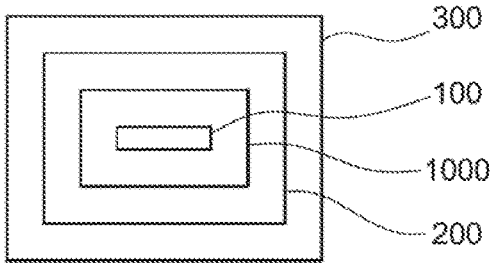
FIG. 15 is a block diagram showing a watch comprising a movement with such a mechanism.
Figure 11:
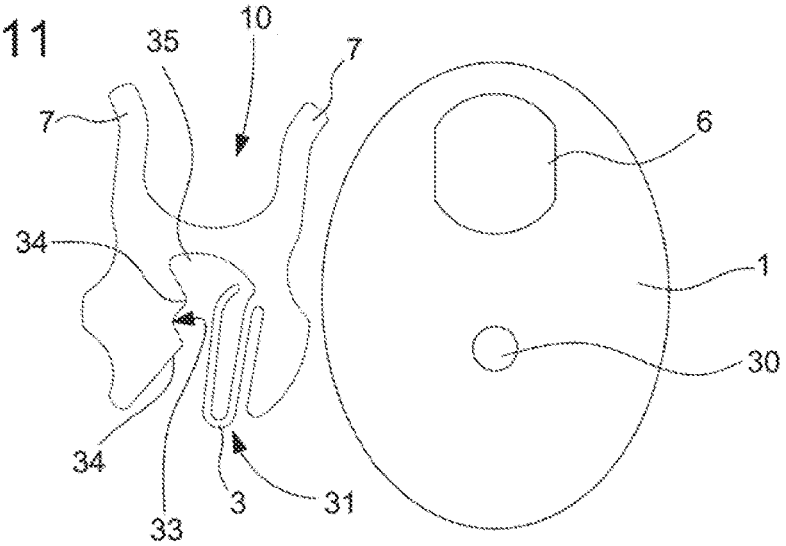
FIGS. 11 to 14 diagrammatically show a plan view of the steps of assembling another alternative embodiment of the braking mobile component, in this case having a single strip, on a structure provided with a bolt, and through which an arbor pivots, which is moreover guided by guiding means not shown and which is to be braked.
Figure 12:
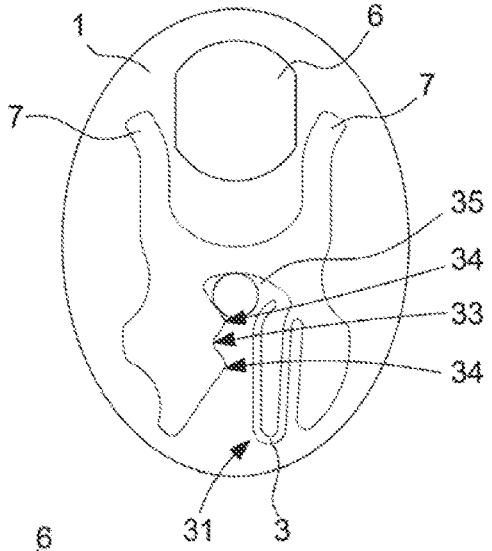

More particularly, and as shown in FIGS. 2, 3 and 8, at least one braking mobile component 10 comprises two straight, parallel strips 31, 32 on either side of the arbor 30, and which exert bearing forces on the arbor 30 in directions that are tangent and parallel to one another, and which are arranged so as to allow for the radial insertion of the braking mobile component 10 about the arbor 30. More particularly, this braking mobile component 10 only comprises these two parallel strips 31, 32.

Figure 4:
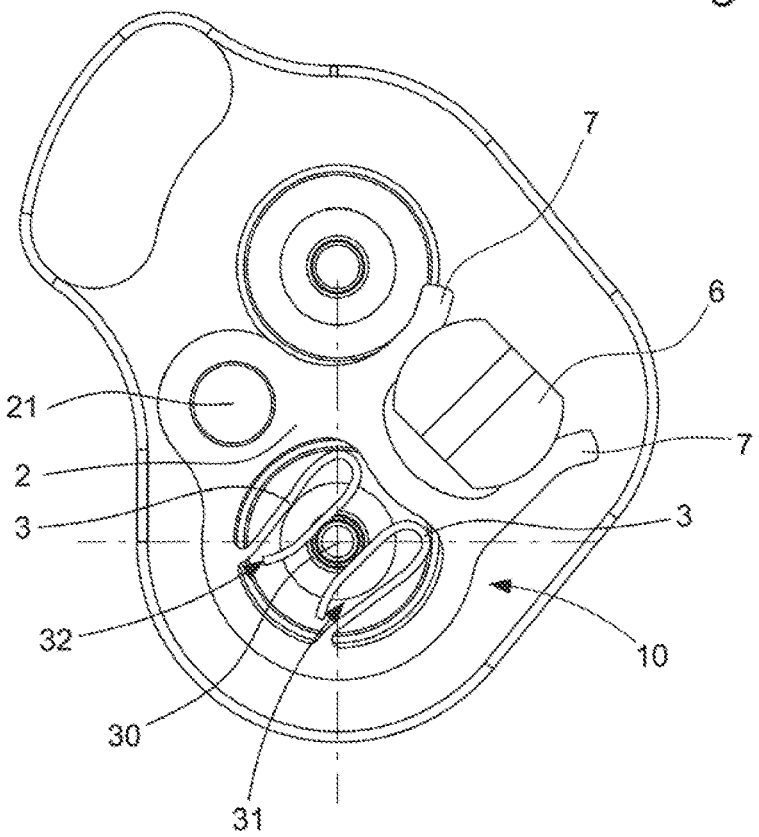
FIG. 4 shows, in a similar manner to FIG. 1, another alternative embodiment of the braking mobile component which comprises two strips, each of which is convex on the arbor side, located on either side thereof, which exert bearing forces on the arbor in directions that are tangent and parallel to one another, and which are arranged so as to allow for the radial insertion of the braking mobile component about the arbor.

More particularly, and as shown in FIG. 4, at least one braking mobile component 10 comprises two convex strips 31, 32, each convex on the arbor 30 side, located on either side of the arbor 30, and which exert bearing forces on the arbor 30 in directions that are tangent and parallel to one another, and which are arranged so as to allow for the radial insertion of the braking mobile component 10 about the arbor 30. More particularly, this braking mobile component 10 only comprises these two convex strips 31, 32.

In another alternative embodiment not shown, at least one braking mobile component 10 comprises a straight strip, which is opposite a convex strip, on either side of the arbor 30, and which exert bearing forces on the arbor 30 in directions that are tangent and parallel to one another, and which are arranged so as to allow for the radial insertion of the braking mobile component 10 about the arbor 30. More particularly, this braking mobile component 10 only comprises these two strips, one of which is straight and the other convex.

More particularly, the braking mobile component 10 comprises two resilient strips 31, 32 arranged on either side of the arbor 30 and jointly forming a hairspring comprising at least one resilient notch 39. More particularly, the first 31 of the resilient strips is substantially straight, and the second 32 comprises two notches 39 arranged so as to ensure friction on a part of the periphery of the arbor 30 about a centre angle $\alpha$ of less than 180° relative to the axis of rotation D.

Figure 13:
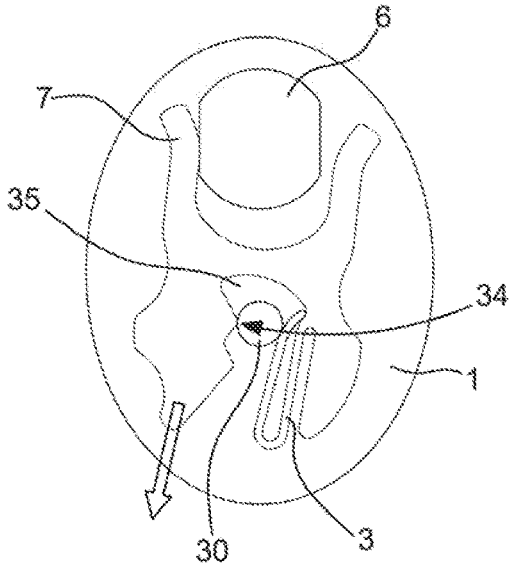
Figure 14:
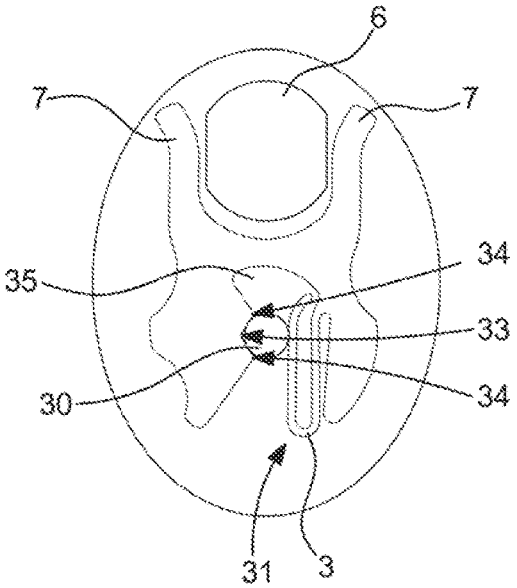

FIGS. 11 to 14 show the steps of assembling another alternative embodiment of the braking mobile component 10, in this case having a single strip, on a structure 1 provided with a bolt 6, and through which structure 1 an arbor 30 pivots, which is moreover guided by guiding means not shown and which is to be braked. In this case, the braking mobile component 10 is a single strip and comprises a single resilient strip 3 forming an open loop 31, one branch whereof is rectilinear, or substantially rectilinear, on the side on which it bears against the arbor 30. These figures show one preferred alternative embodiment where this branch is straight. The braking mobile component 10 comprises, facing this straight branch of the strip 3, a V shape 33 delimited by two apexes 34, and beyond the V shape 33, a blind clearance 35, limited on the side opposite the V shape 33 by the attachment of the resilient strip 3 on the body of the braking mobile component 10. This clearance 35 allows the resilient strip 3 to undergo angular displacement between a position in which it is entirely free, visible in FIG. 12, and a position in which the distal end thereof abuts against the body of the braking mobile component 10, as shown in FIG. 13; and this clearance 35 is further dimensioned so as to allow for the passage of the arbor 30 in an off-centred assembly position, visible in FIG. 12, for relative axial insertion between the braking mobile component 10 and the arbor 30. The resilience of the strip 3 allows for sufficient bending to allow the arbor 30 to clear an apex 34 before being immobilised in the V shape 33. In the working position in FIG. 14, the arbor 30 bears, on one side, against the V shape 33 delimited by its two apexes 34, and is braked on the opposite side by the single resilient strip 3, the forks 7 of the braking mobile component 10 surround the bolt 6 with a small play; this bolt 6 can then be turned one quarter turn in order to limit the axial displacement of the braking mobile component 10 relative to the structure 1.

More particularly, the braking mobile component 10 is asymmetrical relative to the axis of rotation D.

More particularly, the braking mobile component 10 is made in one piece and of a micromachinable material.

The positioning bolt 6 is arranged so as to be fastened onto an implantation comprised in the structure 1, while trapping the braking mobile component 10, so as to provide it with axial play that is limited to a bounded axial value, in the direction of the axis D, and/or so as to provide it with angular play that is limited to a bounded angular value, in a plane perpendicular to the axis D. Thus, the braking mobile component 10 is not fitted inside the structure 1, but is positioned by this bolt 6, which does not block the braking mobile component 10. The bolt 6 leaves the braking mobile component 10 a degree of radial and axial freedom such that it self-centres and thus compensates for the geometrical variations. More particularly, this bolt 6 is formed by a stepped screw.

In a specific alternative embodiment shown in the figures, the braking mobile component 10 comprises, in a plane perpendicular to the axis D, a fork 7. This fork 7 is arranged such that it surrounds a shoulder of the bolt 6 with play that corresponds to the bounded angular value. A top face of this fork 7 is arranged such that it engages in abutment with at least one bottom face comprised in a flange of the bolt 6, in order to limit the axial travel of the braking mobile component 10.

More particularly, this flange comprises, in a first direction, a narrow part, the width whereof is less than that of the opening of the fork 7, in order to allow the braking mobile component 10 to be inserted onto the arbor 30 in the vicinity of the bolt 6 fastened in a first angular position of mobility, on the structure 1. The flange comprises, in a second direction that is preferably but not exclusively orthogonal to the first direction, a wide part, the width whereof is greater than that of the opening of the fork 7. This wide part bears the bottom face which axially immobilises the fork 7 in a second angular position in which it locks the bolt 6.

The bolt 6 can be simply driven into the implantation of the structure 1, or mounted such that it is screwed, or with a bayonet link or other coupling. The axial play, like the radial play, preferably, but not exclusively, lies in the range 10 to 30 micrometres, more particularly in the range 15 to 25 micrometres.

In one specific alternative embodiment, the felloe of the braking mobile component 10 comprises, in a plane perpendicular to the axis D, hollow clearances, diametrically opposite one another in pairs relative to the axis D, and which are provided for the handling of the braking mobile component 10 by a robotic handling clamp, or even for easy grasping by an operator using tweezers.

The braking mobile component 10 can be simply placed on a bearing surface of the structure 1, on which it is preferably held by the bolt 6. In a specific alternative embodiment, the felloe 2 of the braking mobile component 10 comprises, in a plane perpendicular to the axis D, radial bankings which are arranged so as to engage in radial abutment with a counterbore comprised in the structure 1, so as to limit the radial travel of the arbor 30 relative to the axis of rotation D. More particularly, these radial bankings are alternated with all or part of the clearances if the braking mobile component 10 comprises same.

In one specific application of this horological mechanism 100, a mobile component 400 is a small seconds display mobile component, the arbor whereof is generally rolled and slightly conical. The solution proposed by the invention is well suited in this scenario, as a result of the low cost, low overall dimensions, accuracy and surface condition of the components present, and as a result of the easy assembly due to the cone of the arbor of the mobile component.

In another alternative embodiment, the structure 1 comprises a plurality of implantations, which are arranged for the pivoting of different arbors 30 of different mobile components 400, about the same implantation, which is arranged so as to receive a bolt 6 capable of engaging with a braking mobile component 10 arranged on any of the arbors 30. Thus, for example, the system allows different small second centre distances to be managed, while using the same components.

In yet another alternative embodiment, the felloe of the braking mobile component 10 comprises a peripheral shoulder which is arranged so as to engage with clamping, in a plane perpendicular to the axis D, with a counterbore comprised in the structure 1.

In one specific embodiment, the braking mobile component 10 is made in one piece and of a micromachinable material such as silicon, DLC or other material. Manufacture using a lithographic or similar method guarantees high geometrical precision and a good surface condition and more importantly is repetitive.

The invention further relates to a horological movement 200 comprising at least one such horological mechanism 1000.

One specific application of the invention relates to the application thereof to a timing mechanism.

The invention further relates to a watch 300 comprising at least one such movement 200 and/or comprising at least one such horological mechanism 1000.

To summarise, the use of a braking mobile component, as described hereinabove, is particularly advantageous due to the reproducibility of the mobile component's behaviour as a result of the method for manufacturing the braking mobile component. The variation in frictional force, which is prohibitive in the prior art, is reduced or even completely eliminated, resulting in lower operating variations. Moreover, the mechanism is extremely easy to assemble. Finally, the cost of the braking device is reduced, and the overall thickness thereof is very low, which allows for the improvement, at very little expense, of the entire existing loose gear train mechanism comprising a mobile component, in particular a display mobile component, which is sought to be stabilised.

The invention claimed is:

1. A horological mechanism comprising:

a structure bearing at least one first device and/or one second device configured to guide the pivoting of an arbor of a mobile component about an axis of rotation, said structure comprising at least one braking device which is separate and remote, in the direction of said axis of rotation, from any pivoting guiding device comprised in said mechanism, said braking device comprising at least one braking mobile component comprising at least one resilient strip arranged so as to exert a mechanical braking force on said arbor, wherein said at least one braking mobile component extends substantially perpendicular to said axis of rotation, and is mounted such that the at least one banking mobile component is trapped between said structure and a bolt comprised in said mechanism, and is capable of moving at least in a plane perpendicular to said axis of rotation, relative to said structure and to said arbor, wherein either all of the bearing forces on said arbor of all of the resilient strips of the at least one resilient strip comprised in said at least one braking mobile component are exerted within a single angular sector having a centre angle ($\alpha$) of less than 180° relative to said axis of rotation, so as to allow for relative mobility between said at least one braking mobile component and said arbor in a direction of mobility that lies within said angular sector, or said at least one braking mobile component comprises a straight or convex first resilient strip included in the at least one resilient strip arranged so as to tangentially brake said arbor and the direction whereof defines a direction of mobility that is perpendicular to said axis of rotation, and, on a side opposite to said first resilient strip relative to said axis of rotation, at least one second resilient strip, which is arranged so as to allow for relative mobility between said at least one braking mobile component and said arbor in said direction of mobility, said second resilient strip being:

either straight or convex, and arranged so as to tangentially brake said arbor, while being substantially parallel to said first resilient strip, or wavy and comprising at least one resilient notch that is deformable in a direction perpendicular to said axis of rotation and to said direction of mobility.

2. The horological mechanism according to claim 1, wherein said structure bears the first device and the second device for guiding the pivoting of said arbor about said axis of rotation, the first device and the second device being separate and remote from one another and from said braking device.

3. The horological mechanism according to claim 1, wherein said structure bears the first device for guiding the pivoting of said arbor, and said mechanism comprises a first guiding device comprising either a first bearing of said structure engaging in a complementary manner with a first bearing block of said arbor, or a first anchor bearing a first flexible guide member from which said arbor is suspended or to which said arbor is rigidly connected.

4. The horological mechanism according to claim 3, wherein said structure bears the second device for guiding the pivoting of said arbor, and said mechanism comprises a second guiding device comprising either a second bearing of said structure engaging in a complementary manner with a second bearing block of said arbor, or a second anchor bearing a second flexible guide member from which said arbor is suspended or to which said arbor is rigidly connected.

5. The horological mechanism according to claim 1, wherein said at least one braking mobile component has axial mobility, with a first axial play, in the direction of said axis of rotation, relative to said structure and to said arbor.

6. The horological mechanism according to claim 1, wherein said at least one braking mobile component is arranged so as to apply mechanical braking at a constant torque to said arbor.

7. The horological mechanism according to claim 1, wherein said at least one braking mobile component comprises at least one shock-resistant banking which is arranged so as to limit the relative travel between said at least one braking mobile component and said arbor in said direction of mobility.

8. The horological mechanism according to claim 7, wherein said at least one braking mobile component comprises at least two said shock-resistant bankings disposed on either side of said arbor.

9. The horological mechanism according to claim 1, wherein said at least one said braking mobile component comprises two parallel strips arranged so as to allow for the radial insertion thereof about said arbor.

10. The horological mechanism according to claim 1, wherein said at least one said braking mobile component comprises two convex strips arranged so as to allow for the radial insertion thereof about said arbor.

11. The horological mechanism according to claim 1, wherein said at least one braking mobile component comprises two resilient strips arranged on either side of said arbor and jointly forming a spring comprising at least one said resilient notch.

12. The horological mechanism according to claim 11, wherein the first of said two resilient strips is substantially straight, and the second of said two resilient strips comprises two notches arranged so as to ensure friction on a part of the periphery of said arbor about the centre angle ($\alpha$) of less than 180° relative to said axis of rotation.

13. The horological mechanism according to claim 1, wherein said at least one braking mobile component comprises a single resilient strip facing a V shape delimited by two apexes, and comprises a clearance arranged to allow for the relative insertion of a said arbor, and to allow for the displacement of said single resilient strip.

14. The horological mechanism according to claim 1, wherein said at least one braking mobile component is asymmetrical relative to said axis of rotation.

15. The horological mechanism according to claim 1, wherein said at least one braking mobile component is made in one piece and of a micromachinable material.

16. The horological mechanism according to claim 1, wherein one said mobile component is a small second display mobile component.

17. A horological movement comprising at least one horological mechanism according to claim 1.

18. A watch comprising at least one horological mechanism according to claim 1.

* * * * *